US008986786B2

(12) United States Patent
Maier et al.

(10) Patent No.: US 8,986,786 B2
(45) Date of Patent: Mar. 24, 2015

(54) DISTRIBUTION MANIFOLD WITH MULTIPLE DISPENSING NEEDLES

(75) Inventors: Gary W. Maier, Roberts, WI (US); Lars A. Smeenk, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/636,149

(22) PCT Filed: Jun. 15, 2010

(86) PCT No.: PCT/US2010/038582

§ 371 (c)(1),
(2), (4) Date: Sep. 20, 2012

(87) PCT Pub. No.: WO2011/159276

PCT Pub. Date: Dec. 22, 2011

(65) Prior Publication Data

US 2013/0095244 A1 Apr. 18, 2013

(51) Int. Cl.

| | |
|---|---|
| ***F17D 1/08*** | (2006.01) |
| ***B05C 1/08*** | (2006.01) |
| ***B05C 5/02*** | (2006.01) |
| *B05B 7/06* | (2006.01) |

(52) U.S. Cl.

CPC ..... *F17D 1/08* (2013.01); *B05C 1/0813* (2013.01); *B05C 1/0865* (2013.01); *B05C 1/0869* (2013.01); *B05C 5/027* (2013.01)

USPC ..... 427/256; 118/313; 118/110; 118/315; 137/315.01; 425/190

(58) Field of Classification Search

CPC .. B05C 1/0813; B05C 1/0865; B05C 1/0869; B05C 5/027; F17C 1/08

USPC ..... 427/359

See application file for complete search history.

(56) References Cited

U.S. PATENT DOCUMENTS

| | | | | |
|---|---|---|---|---|
| 3,917,888 | A | 11/1975 | Beam | |
| 4,102,301 | A * | 7/1978 | Reade et al. | 118/67 |
| 5,264,036 | A | 11/1993 | Haas | |
| 5,409,732 | A * | 4/1995 | Leonard et al. | 427/10 |
| 5,516,273 | A * | 5/1996 | Delmore et al. | 425/192 R |
| 5,536,517 | A | 7/1996 | Hannaford | |
| 5,750,159 | A * | 5/1998 | Delmore et al. | 425/190 |
| 5,871,585 | A * | 2/1999 | Most et al. | 118/410 |
| 5,882,573 | A | 3/1999 | Kwok | |
| 6,458,211 | B1 | 10/2002 | Wefers | |
| 6,494,954 | B1 | 12/2002 | Bernert | |
| 6,926,772 | B2 | 8/2005 | Leonard | |
| 2003/0021899 | A1 * | 1/2003 | Buecher | 427/359 |

FOREIGN PATENT DOCUMENTS

| | | |
|---|---|---|
| CN | 2530735 | 1/2003 |
| CN | 201067731 | 6/2008 |
| WO | WO 2011/087657 | 7/2011 |

* cited by examiner

*Primary Examiner* — Dah-Wei D Yuan
*Assistant Examiner* — Kristen A Dagenais
(74) *Attorney, Agent, or Firm* — James A. Baker; Stephen L. Crooks; Steven E. Skolnick

(57) ABSTRACT

A distribution manifold having a manifold and a removable cartridge with a plurality of needle tubes extending from the removable cartridge is disclosed. The distribution manifold can be used with a pre-metered coating system to apply coating material to a substrate.

6 Claims, 9 Drawing Sheets

DISTRIBUTION MANIFOLD WITH MULTIPLE DISPENSING NEEDLES

The present invention relates to the application of thin fluid coatings to substrates, particularly substrates in the form of indefinite length webs.

SUMMARY

Two basic categories of coating application systems are excess coat and wipe systems and pre-metered systems. These systems are different in their method of controlling the amount of coating solution applied to a substrate. In excess coating application systems, an amount of solution in excess of the desired coat weight is applied to the substrate. A metering device then removes the excess coating material from the substrate to achieve the desired coating weight. The excess coating material is returned to the reservoir and reapplied to the substrate as it circulates through the system. Due to reuse of the coating material, it can be easily contaminated and then must be thrown away. When contaminated, the entire system must be cleaned and replenished with new coating material resulting in waste and significant production delays.

In a pre-metered application system, the amount of coating material is accurately measured and applied to the substrate to achieve the desired coating weight. Pre-metered application systems do not require removal of excess coating material from the substrate preventing the contamination issues of excess coat and wipe systems. Pre-metered coating application systems can use various types of coating equipment and smoothing devices, such as knives, blades, rods, or rolls, for evenly distributing the pre-metered amount of coating material after it is applied to the substrate surface. In addition, these systems do not provide for recirculation of the coating solution since none of the solution applied to the substrate is removed from the substrate surface and reused.

Slot coater configurations for pre-metered systems are known. One particular system for applying coating material to substrates includes a slot orifice coater, which is a coater that extrudes a solution through a gap and applies that extruded solution directly from the gap onto a moving substrate. In order to achieve a uniform distribution of coating material across the width of the substrate, it is necessary for the pressure within the slot coater to be relatively constant along the length of the slot. Therefore, slot coaters of this type are typically used with coating materials having high viscosities and being coated at high coating weights. Under these conditions, it is relatively easy to maintain a uniform coating across the web. When these coaters are used with lower viscosity coating materials and/or lower coating weights, it becomes more difficult to maintain uniform velocity and uniform hydrostatic pressure along the length of the slot resulting in non-uniform coating of the substrate.

The inventors have determined that use of a distribution manifold having a plurality of needle tubes for dispensing the coating material significantly improves the coating uniformity across the width of the substrate. Moreover, when the needle tubes can be readily removed and changed, the length and/or diameter of the needle tubes can be sized to improve the cross web uniformity and/or to meter more or less coating material onto the substrate resulting in rapid reconfiguration of the distribution manifold for coating different materials having substantially different viscosities.

Furthermore, the inventors have determined that the needle tubes on the distribution manifold can be inserted into the rolling bank of extruded coating material resulting in better coating uniformity than produced by round multiple orifice (RMO) coating dies as disclosed in U.S. Pat. No. 5,871,585. When the needle tubes are inserted into the rolling bank of extruded coating material, the distribution manifold positioning system can be less precise and less expensive than that of a RMO die for a given coating process.

In one aspect, the present disclosure is directed to a method of applying a coating material onto a substrate comprising: conveying the substrate past a contacting element; providing a distribution manifold having a cavity and a plurality of needle tubes in fluid communication with the cavity, the plurality of needle tubes each having a needle tip for dispensing coating material towards a point of contact between the substrate and the contacting element; and dispensing coating material from the needle tubes at a predetermined rate, the rate being less than or equal to a maximum rate that the interaction between the substrate and the contacting element would permit to pass the point of contact.

In another aspect, the present disclosure is directed to a system for applying a coating material onto a substrate comprising: a contacting element; a web path moving the substrate past the contacting element; a distribution manifold having a cavity and a plurality of needle tubes in fluid communication with the cavity, the plurality of needle tubes each having a needle tip dispensing a coating material towards a point of contact between the substrate and the contacting element; a flow control apparatus metering a flow of the coating material from the needle tubes at a predetermined rate.

In another aspect, the present disclosure is directed to a distribution manifold comprising: a manifold having a coating material inlet feeding an internal cavity and a plurality of conduits extending from the internal cavity, each of the plurality of conduits having their distal end located on a manifold mating surface; a removable cartridge having a body with a cartridge mating surface, a plurality of orifices located in the cartridge mating surface, and a plurality of needle tubes extending from the body in fluid communication with the plurality of orifices; and a clamping mechanism for securing the removable cartridge mating surface to the manifold mating surface such that the plurality of needle tubes are in fluid communication with the plurality of conduits in the manifold.

BRIEF DESCRIPTION OF THE DRAWINGS

It is to be understood by one of ordinary skill in the art that the present discussion is a description of exemplary embodiments only, and is not intended as limiting the broader aspects of the present disclosure, which broader aspects are embodied in the exemplary construction.

Repeated use of reference characters in the specification and drawings is intended to represent the same or analogous features or elements of the disclosure.

Figure 1:
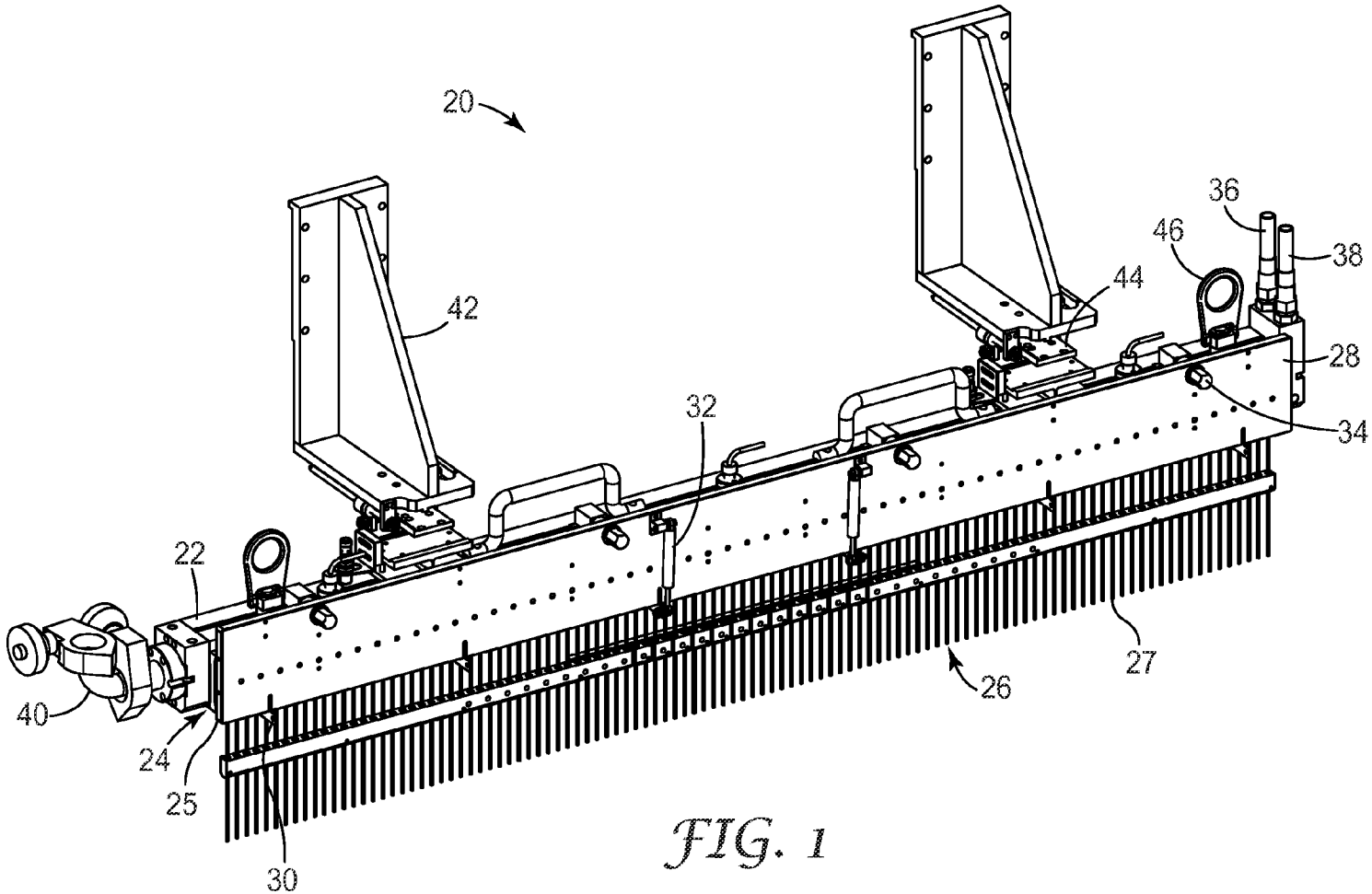
FIG. 1 is a perspective view of a distribution manifold useful in the present disclosure.

Repeated use of reference characters in the specification and drawings is intended to represent the same or analogous features or elements of the disclosure.

DETAILED DESCRIPTION OF THE INVENTION

Figure 5:
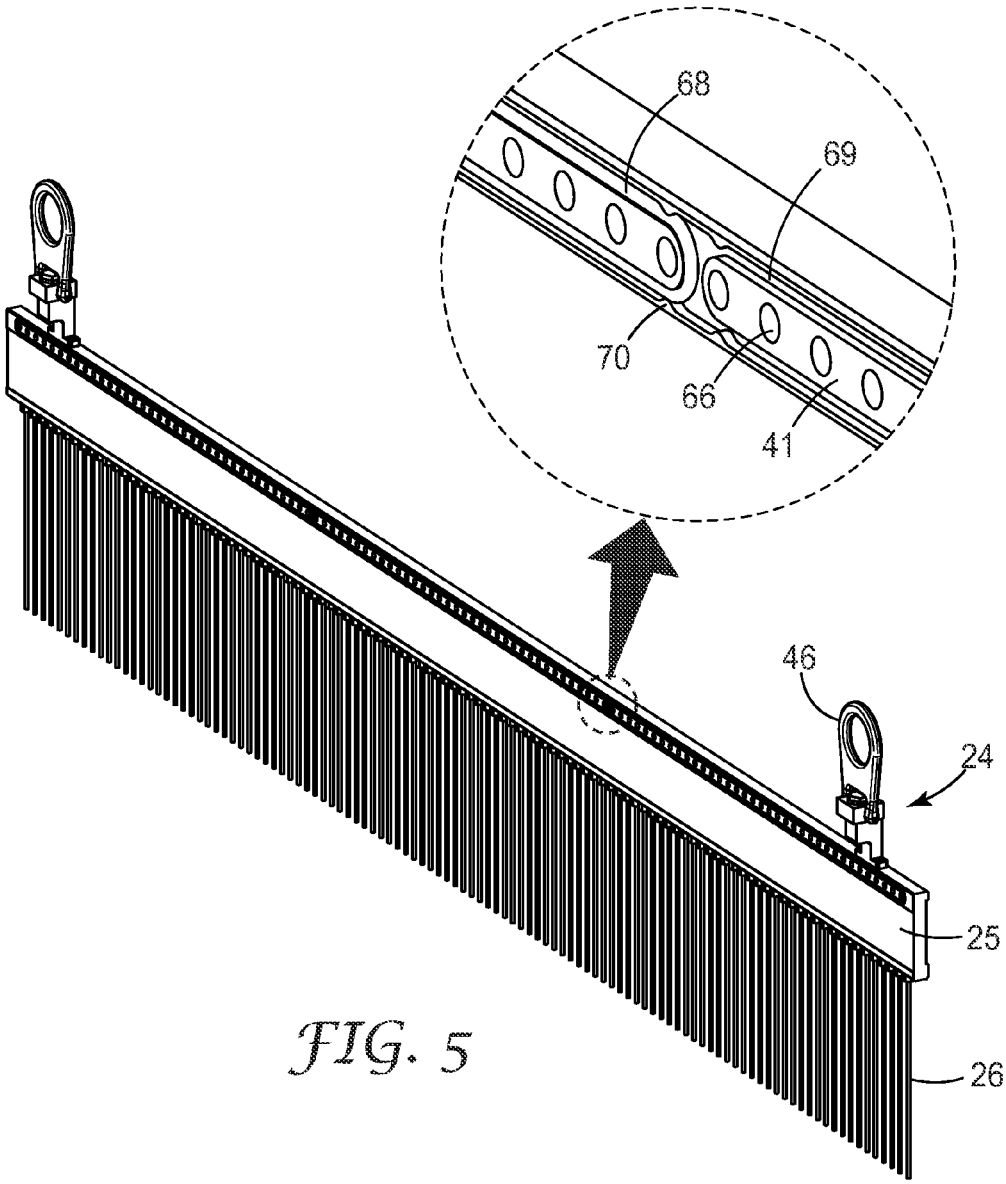
FIG. 5 is a perspective view of the removable cartridge of FIG. 1.

Referring now to FIG. 1, a perspective view of a distribution manifold 20 useful in the present disclosure is illustrated. In one embodiment, the distribution manifold 20 conveniently comprises a manifold 22 and a removable cartridge 24 and a clamping mechanism 23 (FIG. 3) for securing the removable cartridge to the manifold. The removable cartridge 24 has a body 25 with internal passages for supplying coating material to a plurality of needle tubes 26 attached to the body as best seen in FIG. 5. The needle tubes 26 each have a needle tip 27 from which coating material is dispensed, and in some convenient embodiments are threaded into the body 25. This allows the needle tube size (length and/or internal diameter) to be quickly changed to adapt the distribution manifold to apply coating materials having widely varying viscosities or properties. Alternatively, the needle tube size can be intentionally varied across the width of the substrate to profile the applied coating such that more coating is applied in some areas of the substrate and less coating is applied in other areas of the substrate.

A sliding spacer bar can be optionally present to reinforce and assist with maintaining the needle tube alignment if desired. The spacer bar can be designed such that it can be clamped into position without crushing the needle tubes. The linear position of the sliding spacer bar along the length of the needle tubes can be adjusted by moving the bar up and down as appropriate and then clamping it into position. The sliding spacer bar can be constructed from multiple segments that attach to a support bar on the opposite side of the needle tubes to change the CD width of the spacer bar. As the substrate width changes, needle tubes may need to be added or removed from the removable cartridge (unused threaded orifices in the removable cartridge being plugged) and the segmented, sliding spacer bar's length can be adjusted accordingly.

The distribution manifold 20 does not have to be divided into the manifold 22 and the removable cartridge 24 and the needle tubes 26 can be directly attached to the manifold; however, a removable cartridge can reduce cleaning and maintenance time. For example, when changing coating materials or colors, the removable cartridge can be removed and capped without flushing the coating material from the needle tubes and internal passages. The manifold can be flushed and a previously capped removable cartridge with a different coating material can be re-installed to quickly change over to a new coating material. Multiple removable cartridges can be provided for coating many different types or colors of coating materials. The removable cartridges can be readily capped and stored filled with the coating material for re-installation and use at a later time.

Figure 2:
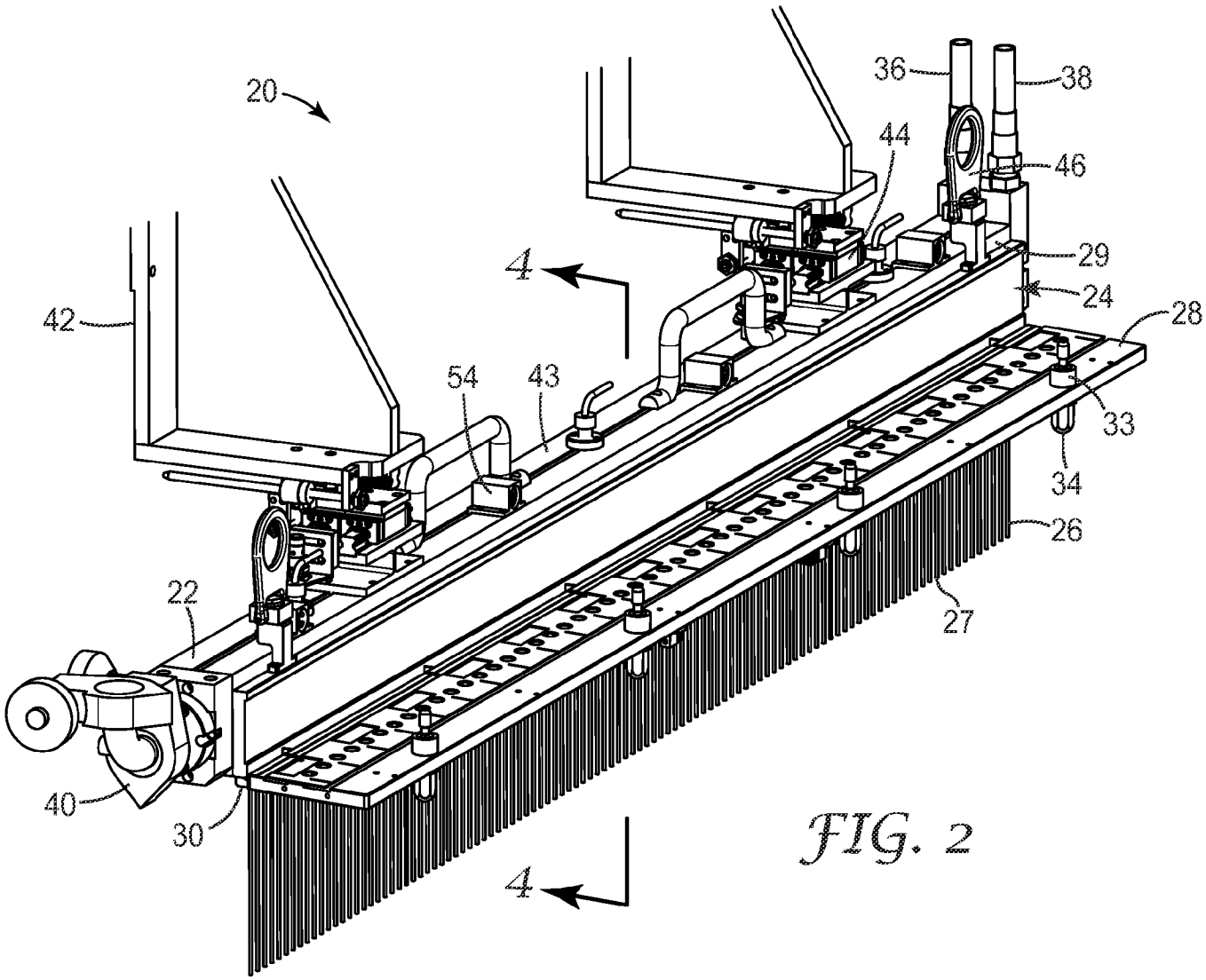
FIG. 2 is a perspective view of the distribution manifold of FIG. 1 when the clamp plate is pivoted into an open position.
Figure 3:
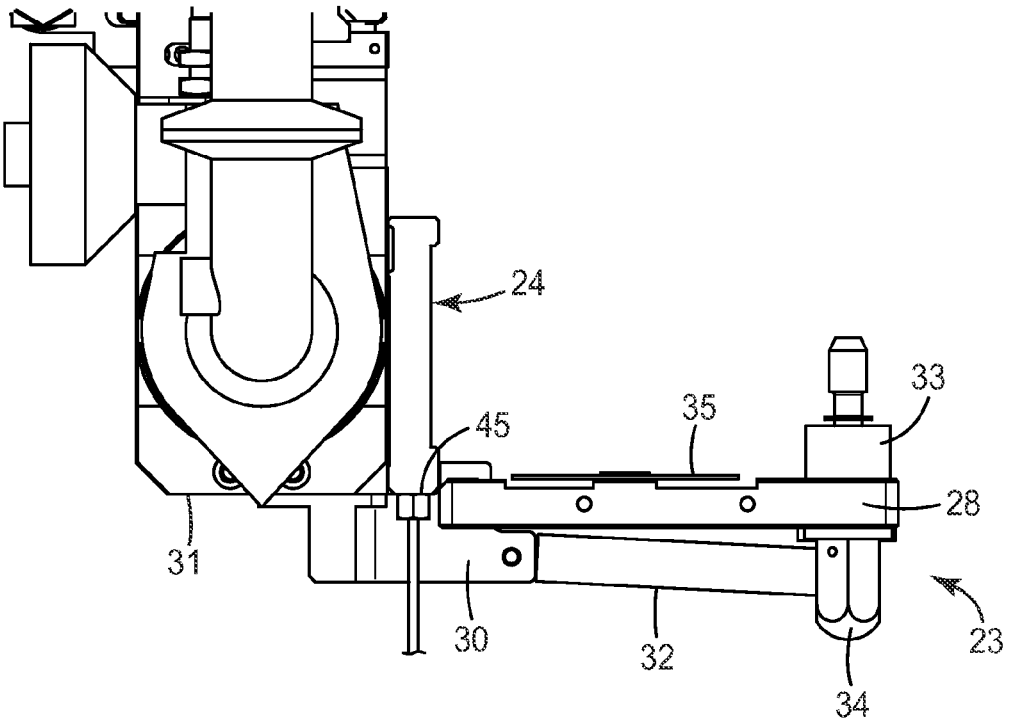
FIG. 3 is an end view of the distribution manifold of FIG. 1 where the clamp plate is pivoted into an open position.

Referring now to FIGS. 2 and 3, views of the distribution manifold of FIG. 1 where the clamp plate 28 has been pivoted into an open position are illustrated. In one embodiment, the removable cartridge 24 is releaseably held against the manifold mating surface 29 of the manifold 22 by a clamp plate 28. The clamp plate 28 has one edge pivotally mounted on hinge brackets 30 attached to a bottom surface 31 of the manifold, which allow the clamp plate to be rotated approximately 90 degrees. Free falling rotation of the clamp plate 28 to the open horizontal position is restrained by a gas spring 32 (or multiple gas springs) having one end attached to the hinge bracket 30 and the opposing end attached to the upper edge of the clamp plate 28. A plurality of spacers 33 and clamping bolts 34, position and fasten the clamp plate 28 into the operating position forcing the cartridge mating face 41 (FIG. 5) into seal tight, fluid communication with the manifold 22. The clamping bolts 34 are screwed into threaded receiving blocks 54 located on an upper surface 43 of the manifold 22. The hinge brackets 30 can include a cartridge slot 45 machined into the hinge brackets for assisting with the alignment of the removable cartridge 24 and to hold the removable cartridge in a vertical position after the clamp plate 28 is rotated into its open position.

A spring plate 35 located between the removable cartridge 24 and the clamp plate 28, which can be attached to the clamp plate in one embodiment, can be used to evenly distribute the clamping force across the width of the removable cartridge 24 and to apply a known clamping force. The clamping force can be calculated based on the spring constant of the spring plate and the allowed deflection of the spring plate as controlled by the length of the spacers 33. In one embodiment, the spring plate 35 produced about 35 pounds of clamping force per linear inch to the removable cartridge 24.

Figure 4:
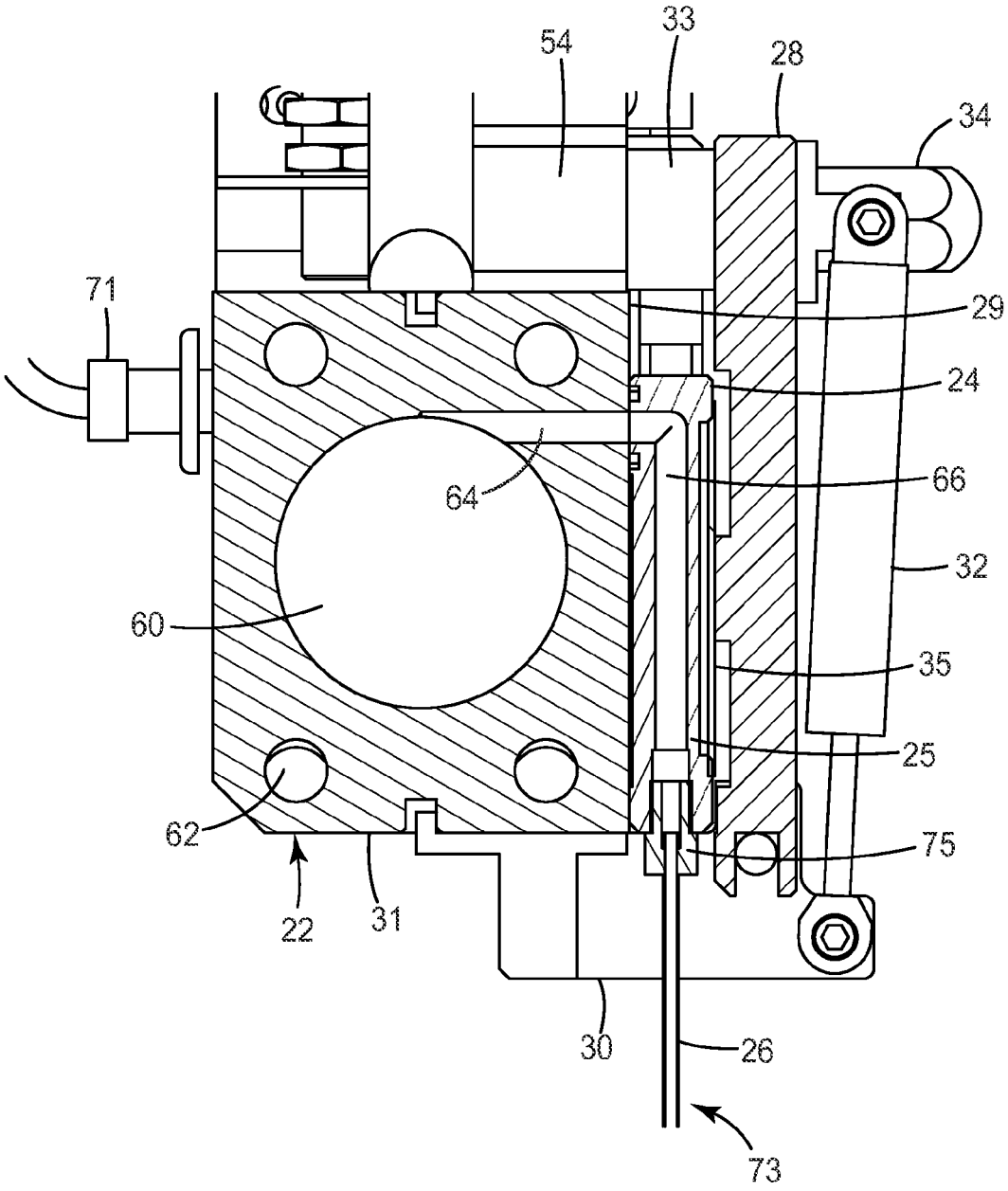
FIG. 4 is a cross-section view taken along section line 4-4 in FIG. 2.

In one embodiment, as best seen in FIG. 4, the spring plate 35 can be attached to a central elevated support located on the clamp plate 28 with both sides of the spring plate 35 extend past the central elevated support. One distal end of the spring plate contacts an upper shoulder and the opposing distal end contacts a lower shoulder located on the removable cartridge 24. The spacer 33 controls the differential height between the central elevated support and the upper and lower shoulders creating more or less flex in the spring plate. While the ordinary artisan will perceive numerous clamping mechanisms known to those of skill in the mechanical arts for attaching the removable cartridge 24 to the manifold 22, the depicted embodiment is a convenient, easy to use method for engaging and releasing the removable cartridge from the manifold.

An embodiment of the distribution manifold 20 also includes an entry port 36 and an exit port 38 for circulating temperature regulating fluid through the manifold 22. This fluid can be used to heat the manifold above ambient temperature in many useful applications of the distribution manifold and the method. If desired, appropriate temperature regulating passages in the removable cartridge 24 can also be provided to circulate the temperature regulating fluid through the removable cartridge. The temperature regulating passages in the removable cartridge can mate with temperature regulating passages in the manifold to circulate the fluid, or additional entry and exit ports can be provided for on the removable cartridge.

Coating material inlet 40 is provided to deliver the coating material that is supplied to the manifold's internal cavity 60 (FIG. 4). A flow control supply apparatus, such as a gear pump or a volumetric displacement pump, is present at or upstream of the coating material inlet 40 to meter the flow of coating material supplied to the distribution manifold at a predetermined rate. In many embodiments, since the coating material being fed to the distribution manifold is metered, when using the distribution manifold to feed a rolling bank of coating material (coating pond), edge dams are not required to contain the coating material.

In many convenient embodiments, mounts 42 attached directly or indirectly to the manifold 22 will be present to install the distribution manifold 20 into a production line. Positioning mechanisms 44 may be conveniently located between the mounts 42 and the manifold 22 to provide for adjustment of the needle tips 27 in the X, Y, Z, or combinations thereof, directions. In the embodiment illustrated, linear slides are provided between the mounts 42 and the manifold 22 to move the distribution manifold 20 in the machine direction and in the cross machine direction to position the needle tips 27. Hoist points 46 may be present on the removable cartridge 24 for easier installation and removal during coating material changes.

Referring now to FIG. 4, a cross-section view taken along section line 4-4 in FIG. 2, and referring to FIG. 5, further details of the distribution manifold 20 and removable cartridge are illustrated. In FIG. 4, the presence of an internal cavity 60 in the interior of manifold 22 can be appreciated. Also seen are temperature regulating passageways 62 for circulating the temperature regulating fluid delivered by ports 36 and 38. A plurality of fluid conduits 64 in fluid communication with the internal cavity are present in the manifold 22 for conducting coating material from the internal cavity 60 to orifices 66 in the removable cartridge 24, through which the coating fluid is delivered to each individual needle tube 26. In one embodiment, each orifice 66 in the removable cartridge aligns with each fluid conduit 64. Alternatively, a lesser number of fluid conduits 64 can be provided to feed one or more secondary internal cavity(s) in the removable cartridge from which the orifices 66 are feed. One or more O-rings 68 located in a groove 69 surrounding all or some of the orifices 66 may be present to ensure a liquid-tight seal between the fluid conduits 64 and the orifices 66. One or more fingers 70 extending into the groove 69 can create pinch points to retain the o-ring in position. A temperature sensor 71 may optionally be present to provide information on the manifold's temperature or the temperature of the circulating fluid in temperature regulating passageways 62 and for use in an automatic control system.

Figure 6:
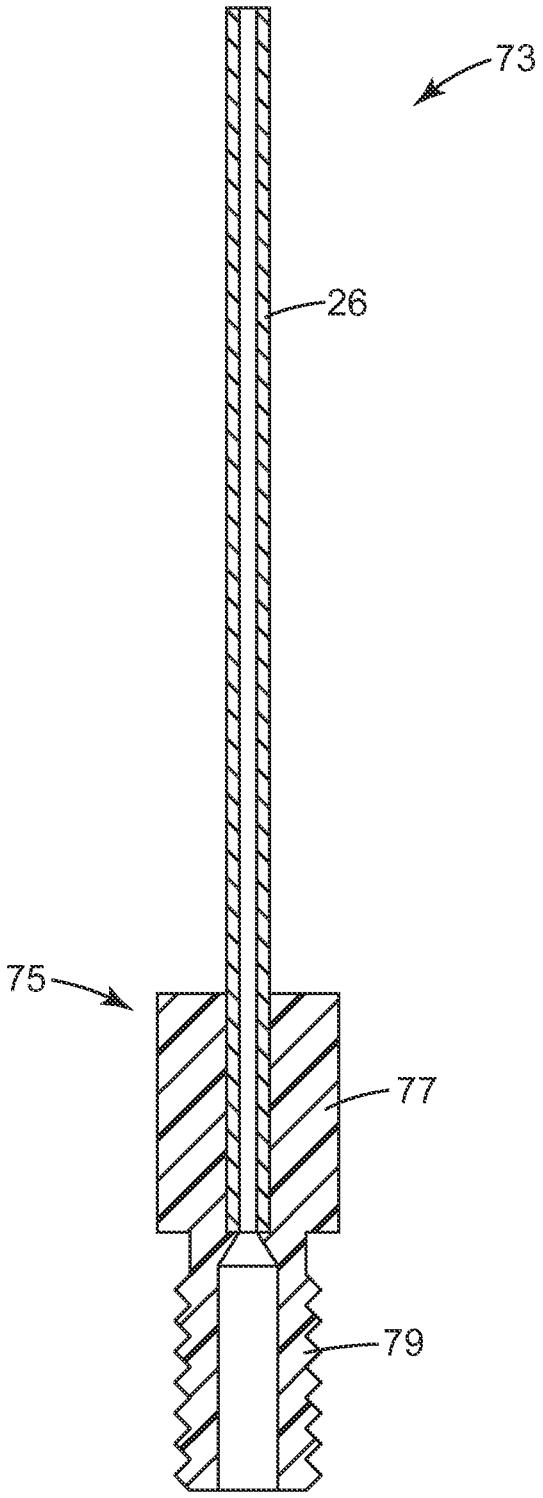
FIG. 6 is a cross section of a needle tube assembly.

Referring now to FIG. 6, a needle tube assembly 73 comprising a needle tube 26 press fit into a coupler 75 is shown in cross section. The coupler 75 is typically made from nylon or metals such as stainless steel or brass. The coupler 75 has a hexagonal head 77 with a threaded cylindrical body 79 and a clearance hole drilled through the cylindrical body 79. A light press fit hole is drilled into the hexagonal head 77 and the needle tube 26 of the appropriate diameter and length is then press fit into the hexagonal head 77. The coupler 75 with attached needle tube 26 can then be screwed into a threaded hole in the removable cartridge 24. Since the coupler 75 can be made from plastic and lower operating pressures are used in the removable cartridge 24, typically no gaskets or sealants are required to prevent leaks once the needle tube assembly 75 is tightened onto the removable cartridge 24. The needle tubes 26 can be used with other types of couplers such as quick disconnect couplers, twist lock couplers, and bayonet couplers if desired. Such couplers are known for use when connecting pneumatic lines or hydraulic lines to machinery. Alternatively, non-removable needle tubes can be directly attached to the manifold 22 or the removable cartridge 24 by suitable methods.

Desirably, the needle tubes 26 are made from stainless steel hypodermic needle tubing that is manufactured to make medical syringes. Other tubing materials can be used and the cross section of the needle tubes can be circular, square, triangular or other geometric shape. In one embodiment, the cross section of the needle tubes is circular. The internal diameter of the needle tubes and the length of the needle tubes can be selected based on the flow rate of the coating material that is applied, the viscosity of the coating material, and the desired operating pressure when coating material is supplied to the manifold 22. Typically, the internal diameter of the needle tubes is between about 10 mils to about 100 mils (0.25 to 2.54 mm), such as between about 40 mils to about 70 mils (1.02 to 1.78 mm). Selection of the internal diameter of the needle tubes is more a factor of the amount of the coating material to be applied and its viscosity. Not all needle tubes connected to the manifold or removable cartridge need to have the same internal diameter and it is possible to supply more or less coating material at various cross machine direction locations if desired.

The length of the needle tubes 26 can be adjusted to vary the manifold pressure needed to supply the desired amount of the second coating. Typically, the length of the needle tubes is between about 2" to about 8" (5.1 to 20.3 cm), such as between about 3" to about 7" (7.6 to 17.8 cm). Sufficient length is desired to produce a laminar flow of the coating material in the needle tubes and to produce a minimally diverging stream of the coating material from the tips of the needle tubes as opposed to a spray or droplets such as would be produced by a spray nozzle. The stream can be continuous or intermittent (pulsed) as needed for the coating application.

Figure 7:
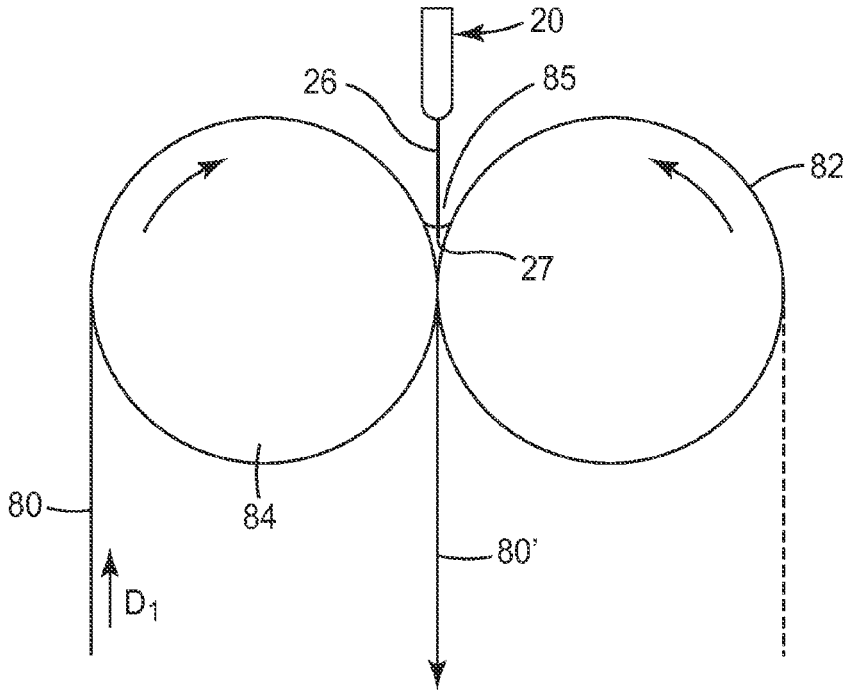
FIG. 7 is a schematic view of a coating process according to one aspect of the present invention wherein the point of contact is at the nip between a forward roll as the contacting element, and a back-up roll.

Longer needle tubes can be required to direct the coating material into a specific location or, in some embodiments, to place the needle tips 27 into a rolling bank of coating material 85 (coating pond) being transferred to the substrate (FIG. 7). Generally, the needle tubes are sized to provide a coating stream from the needle tubes at pressures between about 5 psi to about 20 psi (34.5 to 137.9 kilopascal); although, other pressures can be used. Enhanced cross machine uniformity on the amount of the coating material dispensed by each needle tube occurs as the length of the needle tubes is increased and the coating supply pressure is increased. Enhanced cross machine uniformity can also occur when the needle tips are placed into the rolling bank of coating material as opposed to allowing the coating material to freefall into the coating pond.

The spacing of the needle tubes 26 along the removable cartridge 24 or manifold 22 can be selected to control the uniformity of the coating on the substrate. Additionally, longer spaces or gaps between the needle tubes can be present to create stripes or strips of coating material on the substrate. In general, the spacing between adjacent needles tubes when seeking to produce a uniform coating on the substrate is between about 0.050 in. (0.13 mm) to about 2 in. (5 mm), or between about 0.4 in. (1.0 mm) to about 1.0 in. (2.5 mm). A spacing less than about 0.5 in. generally requires direct attachment of the needle tubes to the manifold or removable cartridge without the use of the coupler illustrated in FIG. 6. The tightest spacing possible is to simply abut the outer diameters of the selected needle tube having the appropriate internal diameter for the coating application. A spacing greater than about 2 inches can lead to non-uniform coating in some applications. Referring now to FIG. 7, a schematic view of a coating process according to one aspect of the present invention is illustrated. A substrate 80 is shown being conveyed along a web path moving the substrate past a contacting element taking the form of a forward roll 82. A distribution manifold 20 is provided wherein the needle tips 27 dispense coating material towards a point of contact between the substrate 80 and the contacting element in the form of the forward roll 82. In this embodiment, the point of contact between the substrate 80 and the forward roll 82 is a nip between the forward roll 82 and a back-up roll 84. In accordance with the method, coating material from the needle tips 27 is being dispensed at a predetermined rate, the rate being no more than the maximum rate that the interaction between the substrate 80 and the forward roll 82 could permit to pass the point of contact. Thus there is no need for recirculation equipment, and coated substrate 80' emerges from the nip. Even though the coating material is being supplied in this manner, a rolling bank of coating material 85 accumulates in the nip between the forward roll 82 and the back-up roll 84. Typically edge dams are not needed to contain the coating material; although, they may be provided if desired.

It has been determined that better cross machine uniformity of the coating material, as applied to the substrate, occurs in some embodiments when the needle tips 27 are submerged into the rolling bank of coating material as opposed allowing a free fall of the coating material though the air when the needle tips are located above the rolling bank of coating material. Submerging the needle tips in the rolling bank of coating material as described can be done with any of the embodiments illustrated in FIGS. 7-11. Optionally, instead of using the configuration of FIG. 7 as a coater, a second substrate shown as a dashed line in FIG. 7 can be wrapped about roll 82 and the distribution manifold used to supply coating material (binder resin) to a lamination nip.

Figure 8:
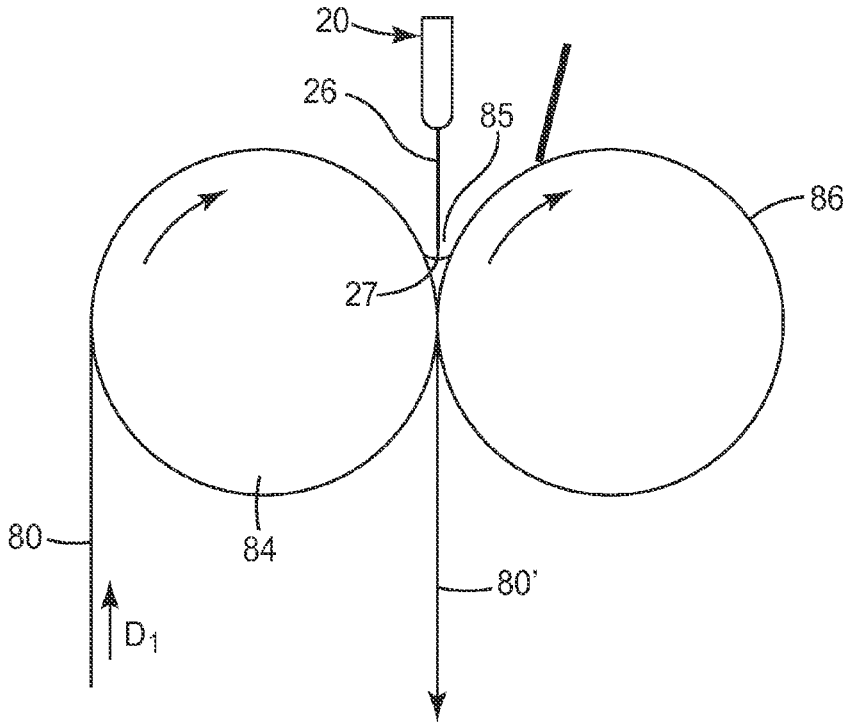
FIG. 8 is a schematic view of a coating process according to another aspect of the present invention wherein the point of contact is at the nip between a reverse roll as the contacting element, and a back-up roll.

Referring now to FIG. 8, a schematic view of a coating process according to another aspect of the present invention is illustrated. This embodiment is similar to the embodiment of FIG. 7, except that the point of contact is at the nip between a reverse roll 86 as the contacting element, and a back-up roll 84. A doctor blade is typically present to clean the reverse roll prior to re-entering the coating pond and nip.

Figure 9:
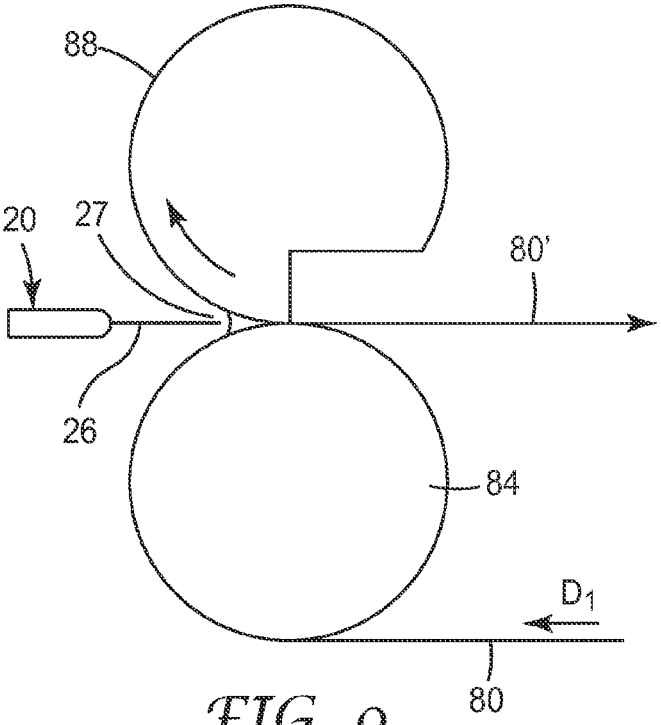
FIG. 9 is a schematic view of a coating process according to another aspect of the present invention wherein the point of contact is at the nip between a notch bar as the contacting element, and a back-up roll.

Referring now to FIG. 9, a schematic view of a coating process according to another aspect of the present invention is illustrated. This embodiment is similar to the embodiment of FIG. 7, except that the point of contact is at the nip between a notch bar 88 as the contacting element, and a back-up roll 84.

Figure 10:
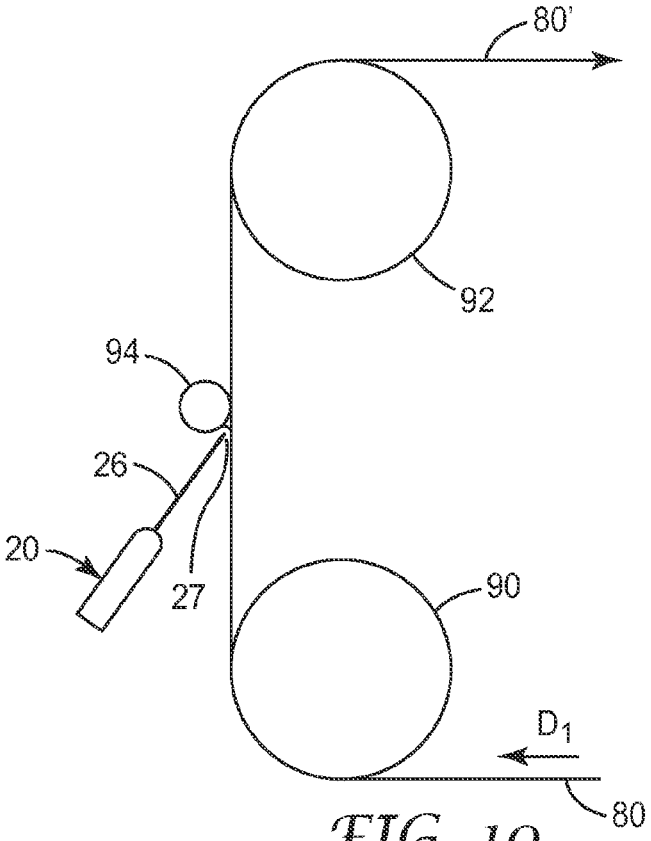
FIG. 10 is a schematic view of a coating process according to another aspect of the present invention wherein the point of contact is at a Mayer rod as the contacting element, contacting a free span of the substrate.

Referring now to FIG. 10, a schematic view of a coating process according to another aspect of the present invention is illustrated. In this embodiment, the substrate 80 is conducted in direction $D_1$ around rolls 90 and 92. The point of contact is present along the free span between rolls 90 and 92, where a Mayer rod 94 serves as the contacting element.

Figure 11:
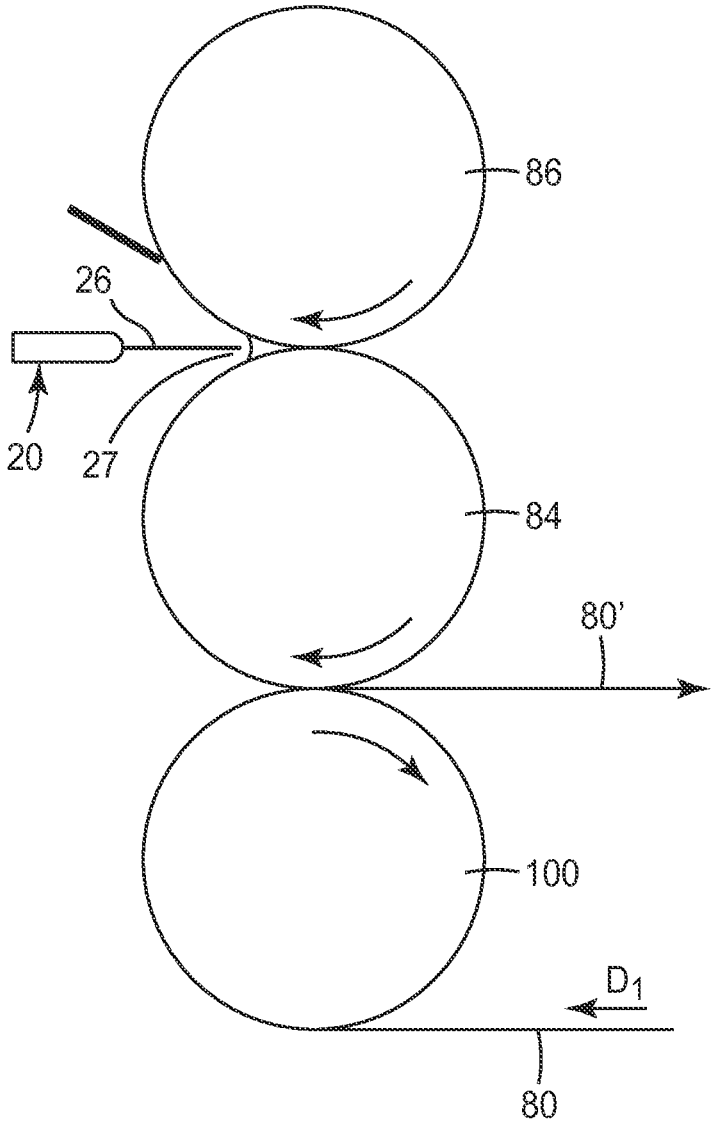
FIG. 11 is a schematic view of a coating process according to another aspect of the present invention, related to that of FIG. 4, but wherein the substrate is further conducted to a nip between the roll and an auxiliary roll.

Referring now to FIG. 11, a schematic view of an offset coating process according to another aspect of the present invention and related to that of FIG. 8 is illustrated. In this instance, the back-up roll 84 is nipped with an offset roll 100. Like in FIG. 8, a reverse roll 86 is nipped with the back-up roll 84 and the distribution manifold 20 feeds the nip between the back-up roll and the reverse roll. A substrate 80 is shown being conveyed around the offset roll 100 transferring the coating material from the surface of the back-up roll 84 to the substrate 80 forming a coated substrate 80'. In accordance with the method, coating material from the needle tips 27 is being dispensed at a predetermined rate, the rate being no more than the maximum rate that the interaction between the back-up roll and the forward roll 82 could permit to pass the nip between them.

Other modifications and variations to the present disclosure may be practiced by those of ordinary skill in the art, without departing from the spirit and scope of the present disclosure, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of applying a coating material onto a substrate comprising:

conveying the substrate past a contacting element;

providing a distribution manifold having an internal cavity and a plurality of needle tubes in fluid communication with the internal cavity, the plurality of needle tubes each having a needle tip for dispensing coating material towards a point of contact between substrate and the contacting element; and dispensing coating material from the needle tubes at a predetermined rate, the rate being less than or equal to a maximum rate that the interaction between the substrate and the contacting element would permit to pass the point of contact wherein the distribution manifold: separates into a manifold containing the internal cavity and removable cartridge having a body with internal passages, a plurality of needle tubes extending from the body and in fluid communication with the internal passages, that the manifold further comprises a plurality of fluid conduits extending from the internal cavity, the plurality of fluid conduits having a distal end located on a manifold meeting the surface and configured to conduct a coating material from the internal cavity to a plurality of orifices of the removable cartridge, wherein the removable cartridge is releaseably held against the manifold mating service into an operating position, and the plurality of needle tubes extend from a body of the removable cartridge in a direction generally parallel to the manifold mating service when in the operating position; and the distribution manifold further comprises a clamping mechanism for securing the removable cartridge such that the coating material can flow from the internal cavity through the plurality of needle tubes; and each needle tip of the plurality of needle tubes is positioned in a rolling bank of the coating material, the rolling bank located immediately prior to the contacting element.

2. The method according to claim 1 wherein the contacting element is a roll and the point of contact between the substrate and the contacting element is a nip between the roll and a back-up roll.

3. The method according to claim 2 wherein the roll is a reverse roll.

4. The method according to claim 2 wherein the roll is a forward roll.

5. The method according to claim 1 wherein the contacting element is a notch bar and the point of contact between the substrate and the contacting element is a nip between the notch bar and a back-up roll.

6. The method according to claim 1 wherein the contacting element is a rod contacting a free span of the substrate.

* * * * *

UNITED STATES PATENT AND TRADEMARK OFFICE

CERTIFICATE OF CORRECTION

PATENT NO. : 8,986,786 B2
APPLICATION NO. : 13/636149
DATED : March 24, 2015
INVENTOR(S) : Gary Maier et al.

It is certified that error appears in the above-identified patent and that said Letters Patent is hereby corrected as shown below:

In the claims

Column 8

Line 16, In Claim 1, delete “substrate” and insert -- substrate, --, therefor.
Line 23, In Claim 1, delete “substrate” and insert -- substrate, --, therefor.
Line 28, In Claim 1, delete “contact” and insert -- contact; --, therefor.
Line 31, In Claim 1, delete “and” and insert -- and a --, therefor.
Line 34, In Claim 1, delete “that the” and insert -- the --, therefor.
Line 37, In Claim 1, delete “meeting the” and insert -- mating --, therefor.
Line 41, In Claim 1, delete “service” and insert -- surface --, therefor.
Line 43, In Claim 1, delete “from a” and insert -- from the --, therefor.
Line 44-45, In Claim 1, delete “service” and insert -- surface --, therefor.

Signed and Sealed this
Twelfth Day of January, 2016

Michelle K. Lee

Michelle K. Lee
*Director of the United States Patent and Trademark Office*